US007344328B2

(12) United States Patent
McAuley

(10) Patent No.: US 7,344,328 B2
(45) Date of Patent: Mar. 18, 2008

(54) OVAL APPLICATOR

(75) Inventor: Brian J McAuley, Guilford, CT (US)

(73) Assignee: Unique Dispensing Systems, Guilford, CT (US)

( * ) Notice: Subject to any disclaimer, the term of this patent is extended or adjusted under 35 U.S.C. 154(b) by 362 days.

(21) Appl. No.: 10/931,629

(22) Filed: Aug. 31, 2004

(65) Prior Publication Data

US 2006/0045609 A1 Mar. 2, 2006

(51) Int. Cl.

| | |
|---|---|
| ***B43M 11/06*** | (2006.01) |
| ***B43K 23/12*** | (2006.01) |
| ***B43K 1/06*** | (2006.01) |
| ***B43K 5/00*** | (2006.01) |

(52) U.S. Cl. ..... 401/264; 401/263; 401/262; 401/206; 401/205; 401/202; 401/265

(58) Field of Classification Search ..... 401/205, 401/263, 261, 264, 265, 266, 262, 202
See application file for complete search history.

(56) References Cited

U.S. PATENT DOCUMENTS

| | | | | |
|---|---|---|---|---|
| 600,299 | A | 3/1898 | Werner | |
| 2,048,689 | A * | 7/1936 | Feasel | 401/205 |
| 2,210,206 | A * | 8/1940 | Fisher | 401/206 |
| 2,613,382 | A | 10/1952 | Patterson | |
| 2,706,474 | A | 4/1955 | Ackerman | |
| 2,873,464 | A | 2/1959 | Rosenthal | |
| 2,974,350 | A | 3/1961 | Schwartzman | |
| 3,137,886 | A | 6/1964 | DeGroft | |
| 3,169,267 | A | 2/1965 | Luedtke | |
| 3,203,026 | A | 8/1965 | Schwartzman | |
| 3,264,676 | A | 8/1966 | Schwartzman | |
| 3,481,678 | A | 12/1969 | Schwartzman | |
| 3,523,628 | A | 8/1970 | Colvin et al. | |
| 3,570,396 | A * | 3/1971 | Schwartzman | 101/125 |
| 3,661,468 | A | 5/1972 | Schwartzman | |
| 4,133,614 | A | 1/1979 | Baginski et al. | |
| 4,342,522 | A | 8/1982 | Mackles | |
| 4,555,194 | A | 11/1985 | Hammond | |
| 4,588,320 | A | 5/1986 | Weinstein | |
| 4,723,860 | A | 2/1988 | Giblin et al. | |
| 4,792,252 | A | 12/1988 | Kremer et al. | |
| 5,713,681 | A | 2/1998 | Venne et al. | |
| 5,810,495 | A | 9/1998 | McAuley | |
| 6,199,240 | B1 | 3/2001 | You | |
| 6,385,806 | B1 | 5/2002 | Katakura et al. | |
| 6,547,471 | B1 * | 4/2003 | Tucker et al. | 401/206 |
| 2002/0067949 | A1 | 6/2002 | Melnik et al. | |

* cited by examiner

*Primary Examiner*—David J. Walczak
(74) *Attorney, Agent, or Firm*—DeLio & Peterson, LLC; Robert Curcio

(57) ABSTRACT

A fluid applicator designed for liquid, cream, or lotion products is easily adaptable for oval shaped containers and other shaped heads, including circular containers. An inner housing is inserted into an outer housing with covering material, such as fabric and/or foam, located between the two housings. The covering material is tightly secured by the two housings. The two housings are permanently attached, preferably by sonic welding to form a subassembly. The inner housing may be formed with or without a domed top surface. A foam pad may be placed over the container's orifice, held in place by a covering material that is placed over the foam pad. Alternatively, depending upon the product dispensed, the foam and fabric covering material elements may be eliminated and replaced by a domed plastic insert with an array of multiple apertures to deliver high viscosity products.

17 Claims, 6 Drawing Sheets

FIG 2A
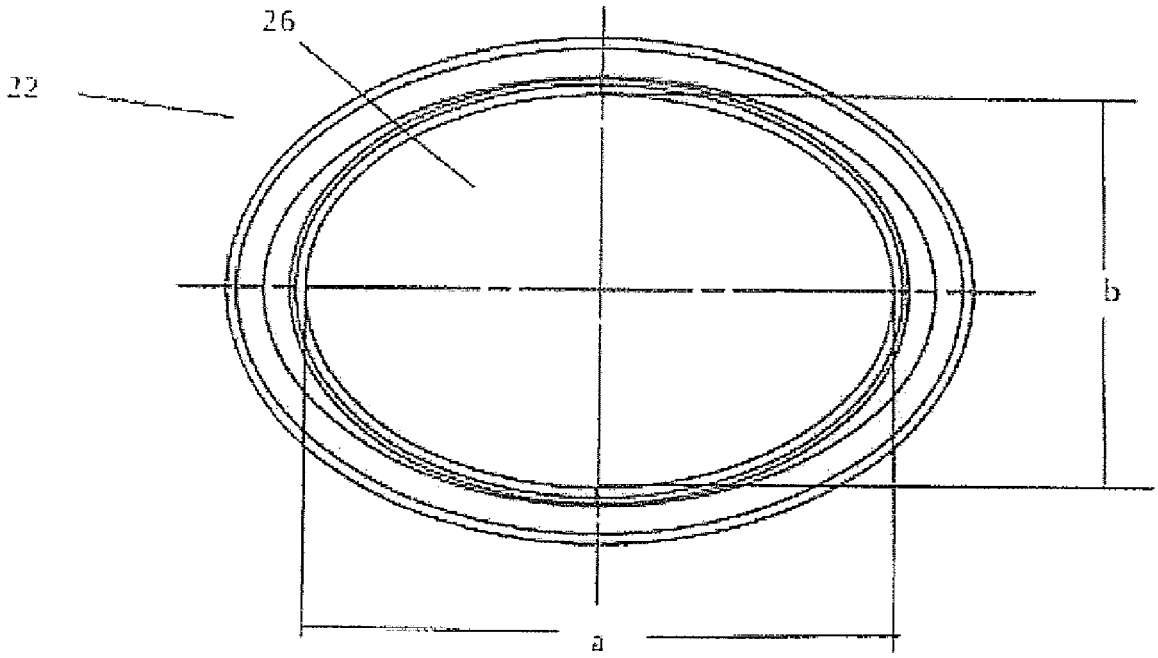
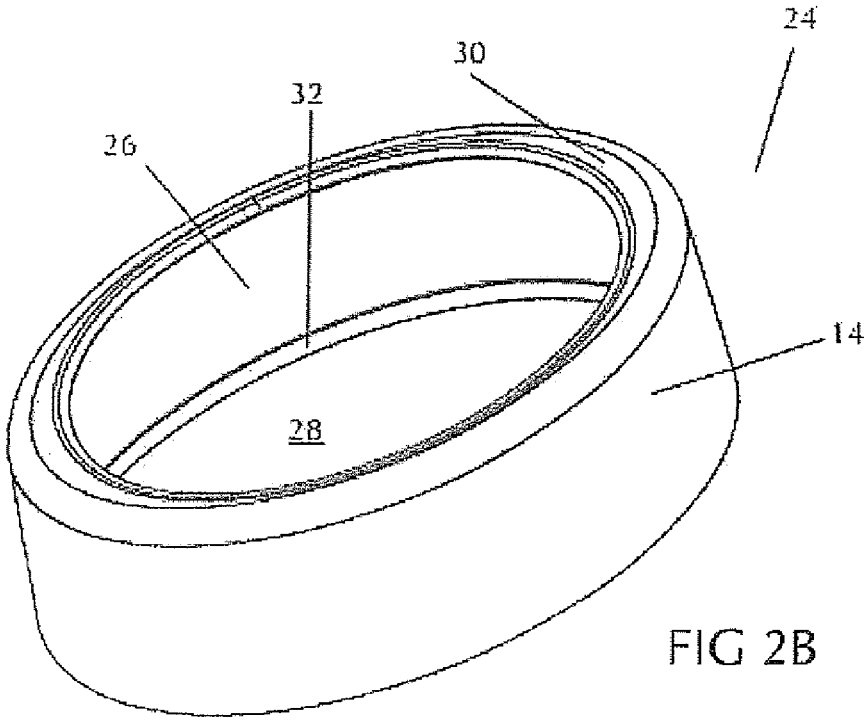
FIG 2B

OVAL APPLICATOR

BACKGROUND OF THE INVENTION

1. Field of the Invention

This invention relates to a fluid applicator or dauber, specifically adapted for dispensing liquids for commercial applications, such as cosmetics, perfumes, marking inks, pigments, shoe polish, lotions, antiperspirants, and medications, to name a few. Specifically, the invention relates to a valve-controlled applicator arrangement for a squeeze tube, bottle, or like container. More specifically, the invention relates to a provision of the applicator integrally formed with means of holding a dauber head with a fabric or foam covering material on a container that does not require a swaging process or separate retaining ring for assembly and is especially well suited for oval or other non-round shaped heads.

2. Description of Related Art

Applicators to dispense liquid products have been on the market in a controlled fashion for many years. Called "dabbers" or "daubers", these devices are generally located within the mouth of a container, and may consist of a plastic component housing that holds a foam or fabric element. The foam or fabric covering material element functions as a reservoir for the product to be dispensed, and releases the product when saturated and depressed between the container and a target surface.

Ball-type dispensers have also been commonly used to dispense small amounts of fluids. Such dispensers include a fluid container surmounted by a bearing, which partially encloses and loosely embraces a plastic ball to afford free rotation to the ball to apply fluid to the desired surface. Ball-type dispensers are limited in the range of product viscosity they can dispense and have been known to be prone to leaks.

In most prior art designs the peripheral portion of a porous applicator pad is secured in a U-shaped channel provided on the outside of the body of the dauber, or in a fitment adapted to fit a dauber body or other product container. The applicator pad is commonly a foam or cloth and foam porous material, that is sufficiently large enough to be wrapped over the mouth of the container and at least partially about a retaining ring securing the peripheral portion to the dauber fitment.

In U.S. Pat. No. 4,133,614 issued to Baginski, et al., on Jan. 9, 1979 entitled, "DAUBER AND METHOD OF ASSEMBLY," a discrete retaining ring is forced into a U-shaped channel on the outside of the dauber along with a peripheral portion of the applicator pad so that the peripheral portion is secured between a retaining ring and an adjacent portion of the wall of the U-shaped channel. Swaging or thermoforming the outer rim of the U-shaped channel inwardly to substantially close the channel and thereby lock the retaining ring and the peripheral portion of the applicator pad therein completes the assembly. Using heat, pressure, and time, the material or cloth element is held in position at the top of the device through this thermo-forming process. Effectively, the plastic edge of the applicator top wall is turned over on itself to trap and contain the material. Applying heat and placing the device under high hydraulic or pneumatic pressure permanently alters the molded shape of the part making it possible to secure and retain the material. Importantly, for the swaging process the periphery of the outer rim must be circular; otherwise the outer rim will buckle and exhibit uneven folds. The distortions due to swaging make this process impractical for non-circular containers.

Other methods of containing the cloth material have been employed, such as crimping metal rings around the material onto the plastic housing container. In U.S. Pat. No. 2,873,464 issued to Rosenthal on Feb. 17, 1959, entitled, "STENCILING DEVICES," a napped fabric is tightly secured over felt fabric by a retaining ring. The ring is a lightweight aluminum band placed over the nap material to hold the material between the ring and the flanges of the base. Slippage becomes an issue when the retaining ring tension is not adjusted properly. By their symmetry, circular containers provide for a uniform retaining ring tension. However, it is desirous in the art to have an assembly method that can be adaptable for non-circular shaped containers, such as oval containers, yet perform at least as efficiently and securely as other securing methods.

For further control, liquid releases from the daubers may be regulated with the use of a mechanical valve generally made from a resilient springy material or spring valve. The spring valve serves to prevent the product from leaking through the device as well as assisting in adjusting the product delivery. The spring valve is disposed within the dauber fitment, having an end that is able to seal close a central passageway that opens to the applicator pad. The spring valve generally consists of vertically winding spring coils, which are yieldable or compressible in a longitudinal direction. The relaxed length of the spring valve is somewhat greater than the distance between the central passageway and the lowermost point of the spring valve's seated mount in the dauber fitment. The effect of the spring valve in its operative position is to bias the endpoint of the valve into the central passageway, thereby closing the opening. Pressing the applicator pad onto a target surface compresses the spring valve and allows liquid to flow out of the central passageway.

In U.S. Pat. No. 6,385,806 issued to Katakura, et al., on May 14, 2002, entitled, "SURFACE TREATING DEVICE," a number of components are configured to form a lustering-agent applicator. The material constituting the treating portion is made of a continuously foamed body coated with a fibrous film. An annular groove is provided on an inside peripheral surface for the engaging structure. An annular engaging member having a distal end is forcibly fitted into an end of the treating portion of the annular groove. The annular engaging member has an elliptical shape and is provided on the outside circumferential surface of the container housing with the engaging portion projecting outward and with a bottom surface having a plurality of engaging projections, such as saw-tooth points. The annular ring is trapped on the outside of a lower housing by a slotted portion in the annular groove with fabric wedged or trapped therebetween. A lip on the annular groove forms the locking mechanism. Although a non-circular design is demonstrated with this assembly method, like other prior art designs the Katakura design requires an annular ring for securing the fabric, with the housing of the container providing an external annular groove to house the fabric and ring with the necessary clamping force. Katakura's annular ring design puts mechanical restraints on the container's housing lip, requiring a forced snap-in fit with the fabric and ring. Furthermore, Katakura requires an assembly from the top without any mechanism for supporting a spring valve. The annular ring support also has slippage limitations that are well known in the prior art.

Bearing in mind the problems and deficiencies of the prior art, it is therefore an object of the present invention to provide an assembly method that is adaptable for non-circular shaped containers.

It is another object of the present invention to provide an efficient and secure assembly process that can accommodate non-circular container shapes while employing foam or fabric, if necessary, for the more porous liquids.

A further object of the invention is to provide a non-circular shaped dauber container that overcomes the slippage and assembly limitations of annular ring supports.

It is another object of the present invention to provide a mass producible dauber container housing and head, which is inexpensive, simple to use, and capable of metering fluid of various viscosities.

It is yet another object of the present invention to provide a non-circular shaped dauber container that can accommodate a spring valve within the housing assembly.

Still other objects and advantages of the invention will in part be obvious and will in part be apparent from the specification.

SUMMARY OF THE INVENTION

The above and other objects, which will be apparent to those skilled in the art, are achieved in the present invention, which is directed to a dispensing head comprising an inner housing including: an inner housing top end; an inner housing bottom open end; a central passageway within the inner housing top end having a diameter to regulate product flow therefrom, the central passageway opening to an applicator pad; and an inner housing peripheral lip at the inner housing top end having a peripheral ridge or groove; an outer housing including: an outer housing top open end; an outer housing bottom open end; and an outer housing peripheral annular lip at the outer housing top open end inwardly facing toward the center of the outer housing and having a peripheral land area for receiving the inner housing peripheral energy director, the outer housing peripheral annular lip in direction of the outer housing bottom open end, the outer housing including an annular ridge or groove at the outer housing bottom open end for attachment to a receiving annular groove or ridge on a product-filled container; the applicator pad fixed between the inner housing and the outer housing, and placed over the central passageway; wherein the inner housing is slideably fixed within the outer housing such that the applicator pad is held between the housings when the inner housing peripheral lip is mated with and secured to the outer housing receiving peripheral lip. The dispensing head includes having the inner housing and the outer housing with a non-circular shape. The dispensing head further comprises a foam pad secured underneath the applicator pad. The top portion of the inner housing may include splines or ridges for directing fluid flow, the splines or ridges extending outward from the central passageway. The top portion of the inner housing may include a plurality of apertures. The inner housing top portion may also be dome shaped having the dome face outward through the outer housing top open end.

The dispensing head of the present invention may further comprise: a hollow cylindrical receptacle having a bottom ridge, centered about the central passageway, and attached to the inner housing top end; a spring valve disposed within the receptacle, securably fixed in position by the receptacle bottom ridge, having a closed end or cap to seal the central passageway, the spring valve including vertically winding spring coils, yieldable or compressible in a longitudinal direction about the receptacle's central axis, such that a relaxed length of the spring valve is greater than the distance between the central passageway and a lowermost point of the spring valve seated mount at the bottom ridge of the receptacle, the spring valve forming an annular ring orifice with the central passageway for product flow when compressed during application.

In a second aspect, the present invention is directed to an applicator for dispensing fluid to a surface comprising: an oval shaped container having a top orifice with a first annular ridge or groove and a shoulder with at least one annular ridge or groove, for mating with a dispensing head; the dispensing head including: an oval shaped outer housing having a corresponding outer housing annular groove or ridge for mating with the at least one annular ridge or groove on the shoulder of the container, the outer housing having an inwardly facing top lip; an oval shaped inner housing slideably inserted within the outer housing and having contact with the inwardly facing top lip, the inner housing having an inner housing annular groove or ridge for locking into and securing to the container top orifice, such that the inner housing securably mates with a neck portion of the container, the inner housing having a central passageway of predetermined diameter to regulate product flow therethrough; a covering material adapted to serve as a reservoir for the product and promote product flow during application, the covering material wedged and held securely between the inner and outer housings when the housings are fixably attached; the housings secured together with the covering material wedged therebetween; wherein the housings may include at least one mating ridge and groove to mechanically secure together. The attachment may also be in the form of teeth and groove mating, sonic welding, thermal bonding, or adhesive. In the case of sonic welding, a sonic weld line is formed for locating at least one weld when the inner housing is slidably inserted within the outer housing.

In a third aspect, the present invention is directed to a method for forming a dispensing applicator comprising: forming an oval shaped inner housing having a top end with an annular lip and a central passageway centered on the top end; forming an oval shaped outer housing having a top open aperture with a circumferential annular lip for mating with the inner housing annular lip, and a bottom open end having an annular ridge or groove; placing a shaped covering material cut to fit over the inner housing top end; inserting the outer housing over the covering material subassembly so as to trap the covering material between each housing; mechanically at least a portion of the inner housing annular lip is mated to the outer housing annular lip with the covering material securely fixed therebetween to form a dispensing head; attaching the dispensing head to a top end of a tubular shaped container having a shoulder portion and a neck portion, the shoulder portion including an annular groove or ridge for attaching to the outer housing, the neck portion having an orifice with an annular lip for sealably attaching to the inner housing; filling the container with viscous fluid; and for tubular constructions, sealing the container bottom end after filling. The method may include inserting a spring valve within a receptacle of the inner housing, the spring valve centered about the central passageway, having a cap for sealing the central passageway, and forming a ring orifice with the central passageway when the cap is compressed during application to promote product flow. The method further comprises placing a foam pad between the covering material and the inner housing before the inner housing is securably attached to the outer housing. The method may also include forming the inner housing with a dome shaped top surface, and locating the central passageway in approximate center of the dome shaped top surface, or locating a plurality of apertures about the top surface in place of a single central passageway.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

FIG. 2A depicts a top view of the outer housing.

FIG. 2B depicts an angled side view of the outer housing.

DESCRIPTION OF THE PREFERRED EMBODIMENT(S)

In describing the preferred embodiment of the present invention, reference will be made herein to FIGS. 1-7 of the drawings in which like numerals refer to like features of the invention.

The present invention introduces a fluid applicator design for liquid, cream, gel or lotion products that is easily adaptable for oval shaped containers and other shaped heads, including the common circular containers. In many instances, circular container heads have little or no capacity for an anatomical adaptation to different parts of a user's body. Thus, non-circular container heads, such as elliptically shaped heads, are preferred in certain application uses. Generally, the fluid is applied through a foam and/or fabric covering material located and secured on the container head. However, unlike the prior art solutions, the present invention does not use a swaging process or annular ring to seal the covering material to the package. Since swaging is not easily applied to non-circular designs, this allows the present invention to be utilized more easily for non-circular container shapes and container head shapes. The package seals the foam and/or fabric covering material by securing an outer housing to an inner housing. In the present invention, the foam and/or fabric covering material are compressed between the outer and inner housings. The housings are then secured together, preferably by sonic welding, although other methods of securing are acceptable, such as teeth and groove mating, thermal bonding, or adhesive, and the invention is not limited to any single securing method. Cloth, non-woven covering material, reticulated polyurethane foam, porous neoprene, or other such fibrous material that permits permeation of the fluid may be used as the covering material. The fluid is generally occluded in the fabric or covering material, or in a foam body or felt pad placed underneath the covering material, and is dispensed when the covering material is pressed against a target surface.

Figure 1:
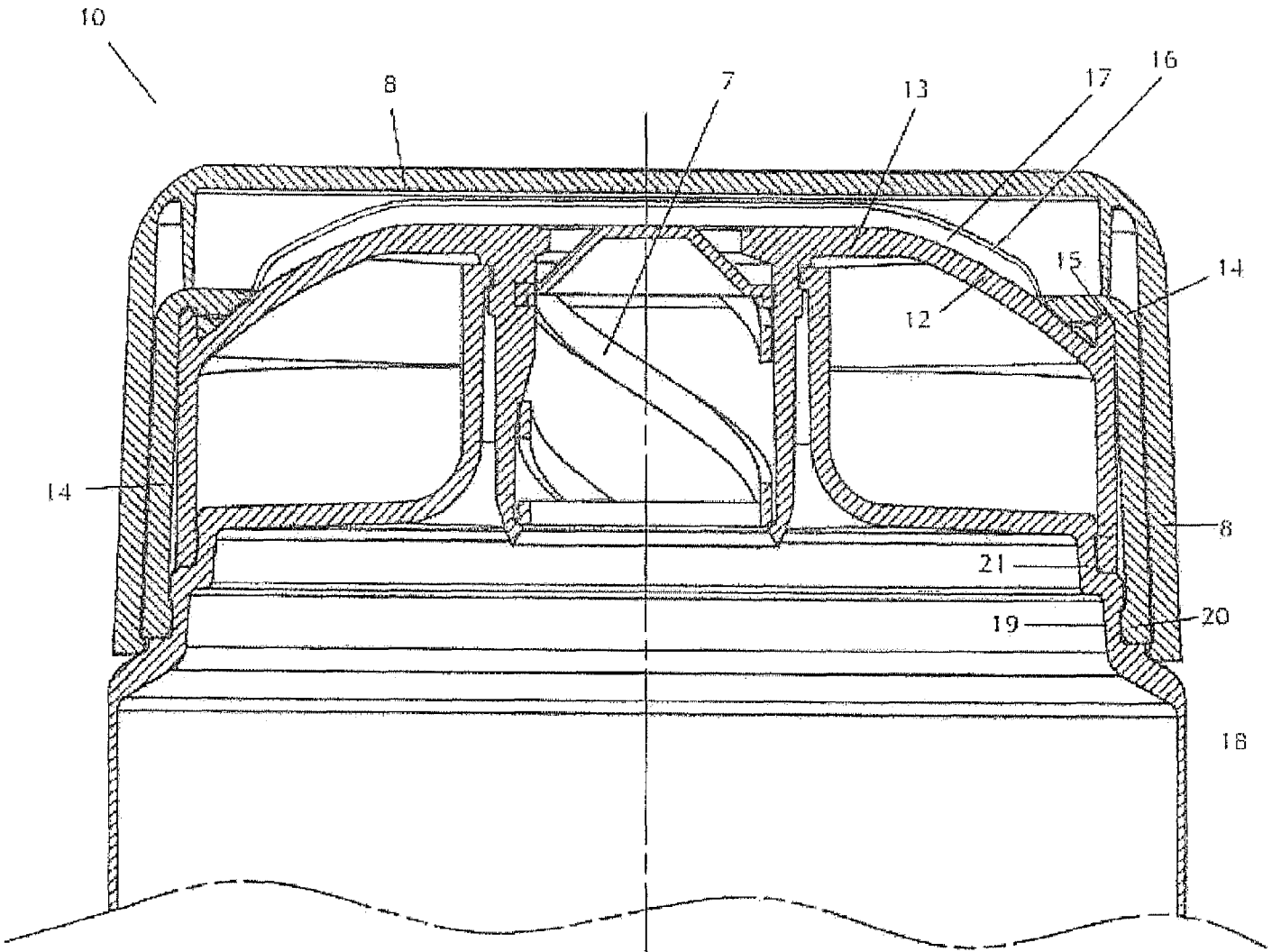
FIG. 1 depicts an overall assembly drawing of the oval shaped container head of the present invention.

FIG. 1 depicts an overall assembly drawing of an oval shaped head 10 of the present invention. An inner housing 12 is inserted into an outer housing 14 with covering material 16 and an optional foam ad 17 located between the two housings. The covering material is tightly secured between the two housings. The two housings are held together, preferably sonic welded, to form a subassembly. Weld points 15 are introduced at the junction of the two housings. The assembled housing is then attached to the container 18, by sliding a peripheral annular lip or ridge 20 on the lower portion of the outer housing 14 over an annular ridge or groove 19 located on the tube neck and locking thereon.

The head 10 may also be secured to the neck of the container by snapping an annular engaging member, such as a peripheral lip or ridge, on the inner surface of the inner housing 12 into place within another annular groove 21 on the neck. The reverse attachment scheme may also be used, where the head is formed with an annular groove and the shoulder is formed with a peripheral lip or ridge.

When the dispenser is not in use, cap 8 is secured over the head 10 and form fitted to the shoulder. The cap may be predominately airtight to protect the dispensing fluid and the foam covering material from drying out.

In at least one embodiment, a spring valve 7 is centrally held in place within a cavity in the inner housing 12. The spring valve 7 is made to compress upon application, opening a circular orifice in the cavity for dispensed fluid to flow. The top portion 13 of inner housing 12 is dome shaped with a central aperture to allow the fluid to flow from the applicator. The central aperture forms a seal with the spring valve when the valve is not under compression.

The head is preferably of elliptical shape, although the present invention is not so limited. The invention is easily adaptable for circular, rectangular, and other non-circular shapes. The housings are preferably of unitary or integral construction formed, for example, through injection molding using a plastic such as polyethylene, polypropylene, or other suitable material. It is hardly necessary to explain the design and construction of the specific container selected for any particular product, apart from the limited design constraints discussed further herein. The container design is not a limiting factor in the practice of the invention and may be varied widely as the circumstances suggest or demand. The exact structure shown for purposes of illustration can be considered as a representative embodiment, since it has been found to give satisfactory results under actual working conditions.

FIG. 2A depicts a top view 22, and FIG. 2B depicts an angled side view 42 of the outer housing 14. The outer housing is essentially an oval tube portion having a top open end 26, a bottom open end 28, and an annular lip 30 formed at the top open end 26 that is inwardly facing toward the center of the housing. Annular lip 30 mates with the inner housing peripheral lip 47 (shown in FIG. 3B) when it is inserted and prevents the inner housing from being inserted past the top open end. When inserted, the inner housing will slide up to and mate with annular lip 30, forming a mating junction for attachment. The attachment may be by teeth and groove mating, sonic welding, thermal bonding, or adhesive.

The outer housing 14 is preferably made of a high rigidity material, such as polyethylene, and the like. The outer housing may also have an annular groove 32 on the lower portion at the bottom open end 28, which is then adapted to receive an annular ridge or lip on the shoulder portion of the container. Top view 22 depicts the preferred elliptically shaped design showing the top open hole 26 with major axis "a" and minor axis "b". The ratio of lengths from major axis to minor axis will vary with application and usage.

Figure 3A:
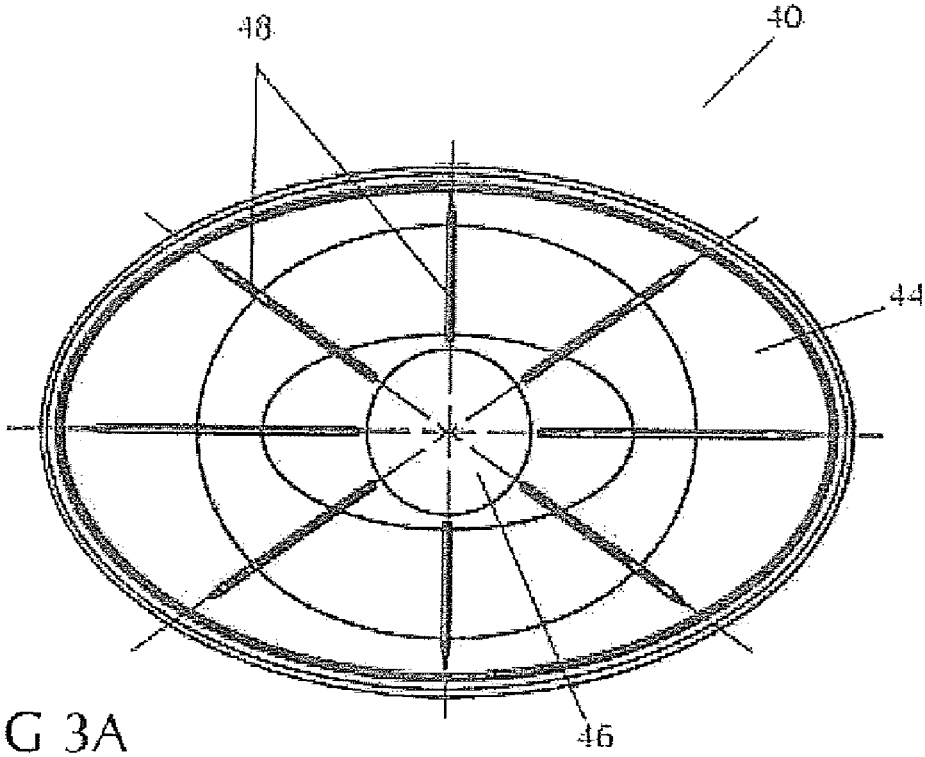
FIG. 3A depicts a top view of the inner housing of the present invention.
Figure 3B:
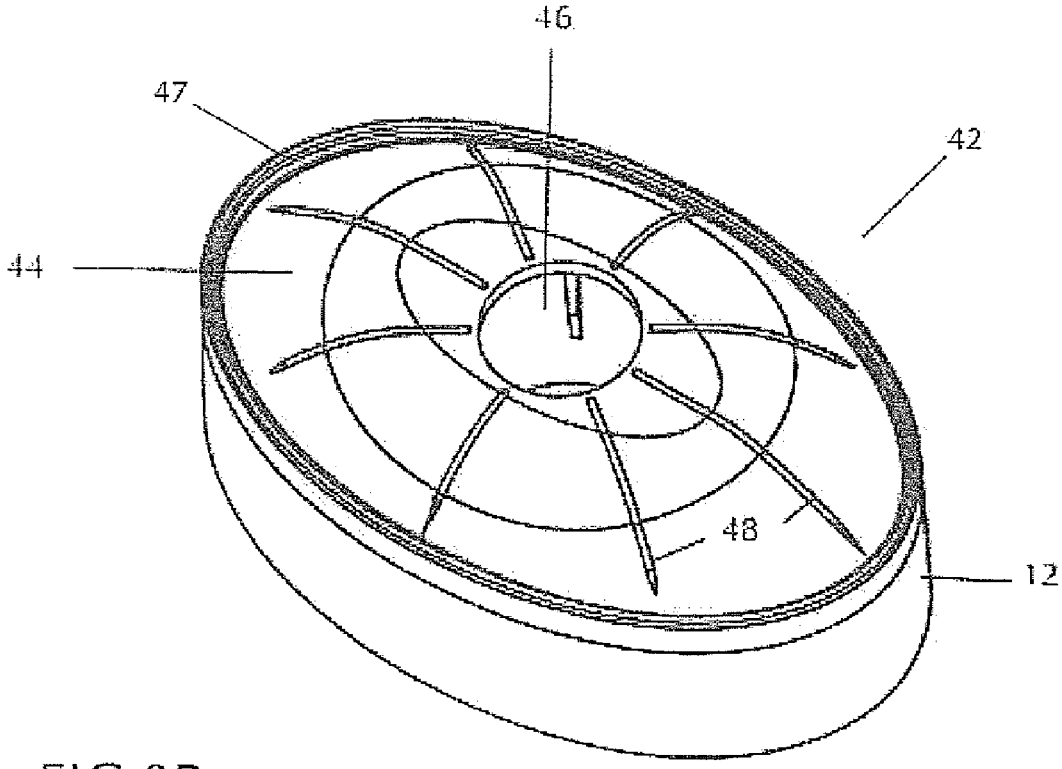
FIG. 3B depicts an angled side view of the inner housing of the present invention.

FIG. 3A depicts a top view 40, and FIG. 3B depicts an angled side view 42, of one embodiment of the inner housing 12 of the present invention. In this embodiment, the inner housing shown has a domed top surface 44 with central passageway or orifice 46. Peripheral lip 47 extends about the top end of inner housing 12. During application the fluid flows from the container through the central passageway 46 onto a covering material that is securely wedged between the inner and outer housings. The inner housing is domed for certain applications, as indicated in FIG. 3B; however, a non-domed version may also be employed for other applications, and the invention is easily adaptable for either configuration. The domed top surface 44 serves to support the covering material, pillowing it to form fit the dome shape. The dome top surface 44 is structurally rigid to keep its shape, slightly compressing under pressure during fluid application, and is made of material with elastic memory to resiliently retain its shape after application. The dome top surface 44 is depicted with optional raised ribbing on embolden splines 48 to direct the dispensed product as it moves through the central passageway 46 to all outer surfaces of the applicator's periphery. For heavier product, there may be no need for the inherent wicking action of the foam pad; however, the splines would still promote flow of the product to the periphery of the head.

In another embodiment, the inner housing is formed without a domed top surface. A foam pad may be placed over the container's orifice, held in place by a covering material placed over the foam pad.

Figure 4A:
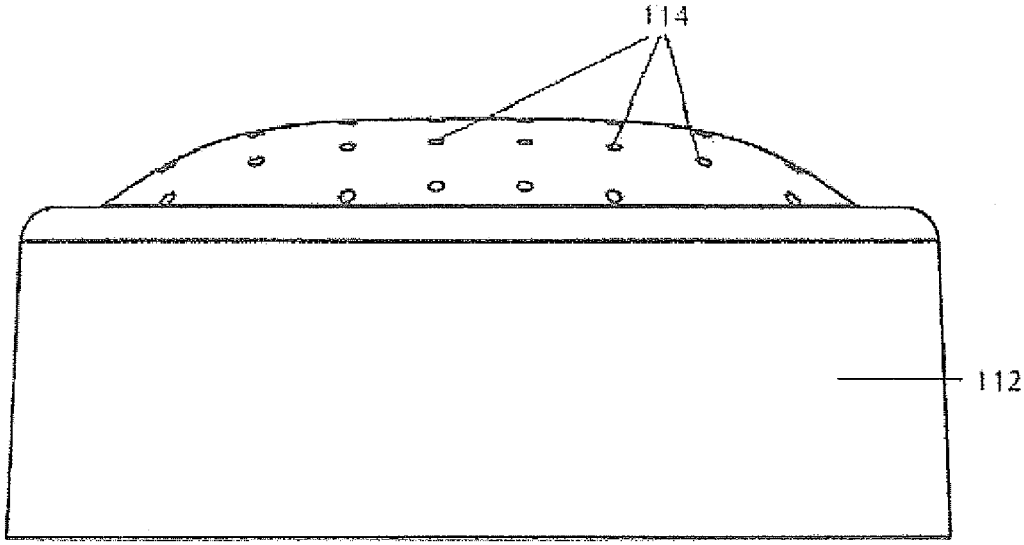
FIG. 4A depicts a dome shaped inner housing having multiple apertures for dispersing product from the applicator.
Figure 4B:
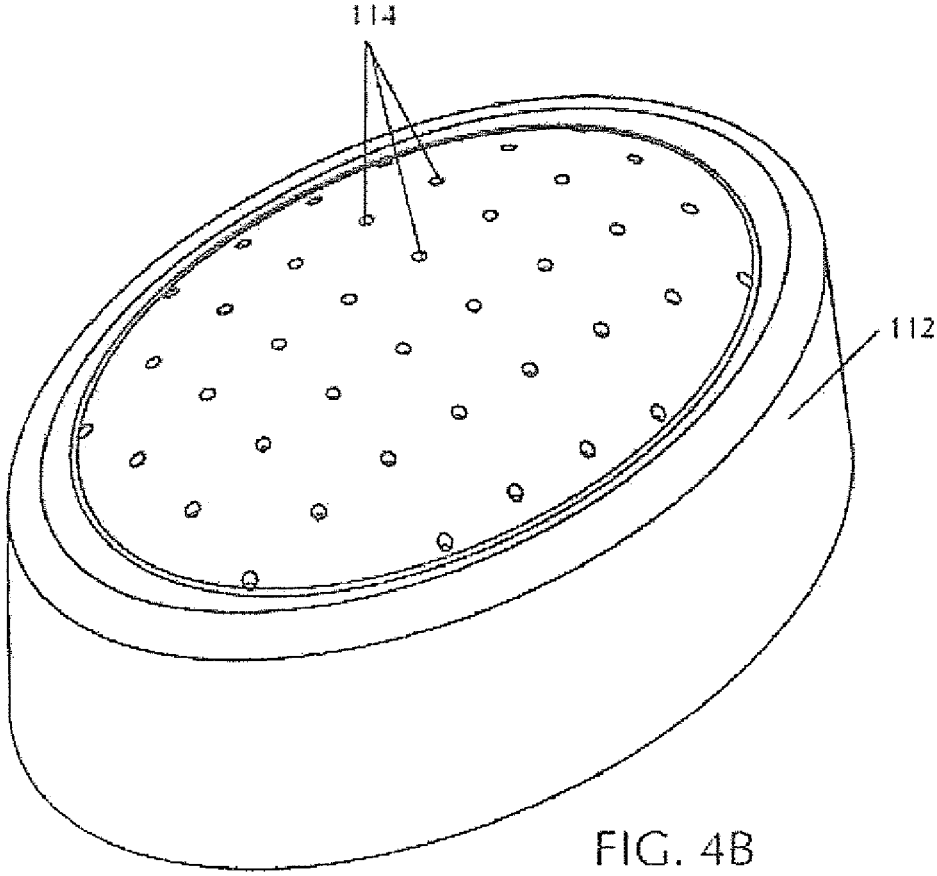
FIG. 4B is a top angled view of the inner housing of FIG. 4A, showing a plurality of apertures about the dome shaped surface.

Alternatively, depending upon the product dispensed, the foam and fabric covering material elements may be eliminated and replaced by a domed plastic insert with an array of multiple apertures to deliver high viscosity products. FIG. 4A depicts a cross section of a dome shaped outer housing 112 having multiple apertures 114 for dispersing product from the applicator. The area immediately under this dome is sized to permit an advantageous amount of product to be retained exterior to the primary container and ready for delivery to the dispensing surface. The dome portion may be fabricated from a material capable of being compressed under pressure during fluid application, with elastic memory to resiliently retain its shape after application. FIG. 4B is a top angled view of the outer housing of FIG. 4A, showing a plurality of apertures 114 about the dome shaped surface. Furthermore, in this embodiment, the inner housing is also constructed with a dome shaped top surface, which serves to form a well between the two domed surfaces for containing the product being delivered.

Figure 5:
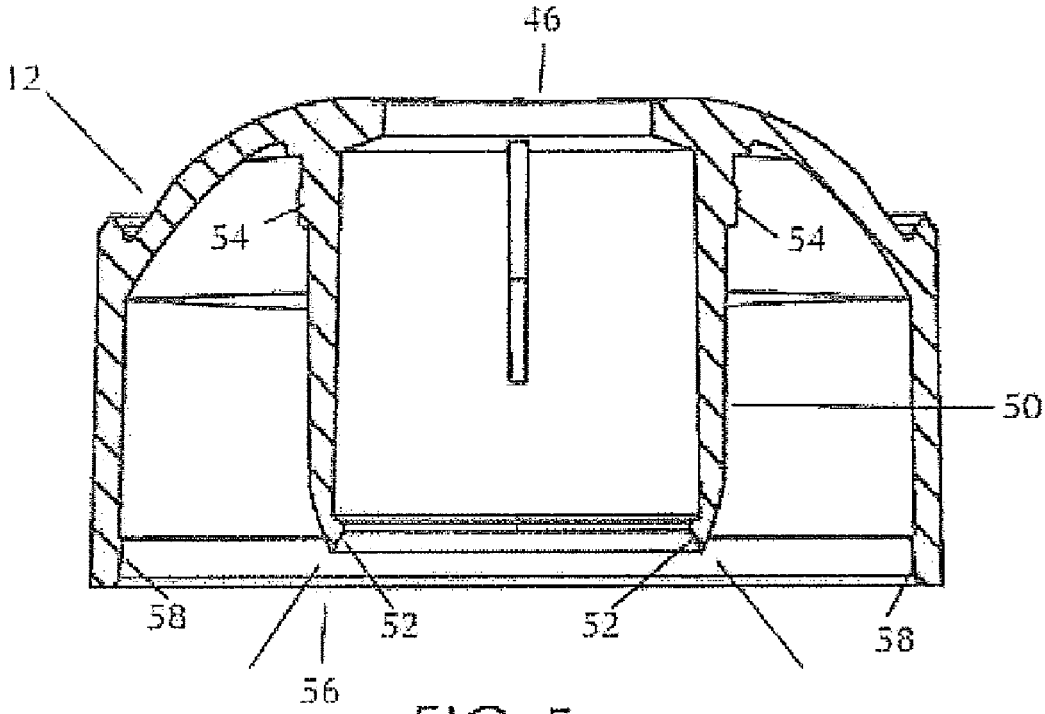
FIG. 5 is a cross-sectional view of the inner housing.

FIG. 5 is a cross-sectional view of the inner housing 12. If the inner housing is constructed to hold a spring valve, a receptacle or spring cavity 50 may be centered about the central passageway 46. It should be noted that in alternative applications, and dependent upon the viscosity of the product being dispensed, a spring valve might not be required.

If a spring valve is necessitated, the spring cavity 50 is formed to hold and secure it in place. The spring valve is a specifically shaped compression spring with actuator head. The bottom end of the compression spring is held at a fixed position by an annular lip or bead 52 located at the bottom of the receptacle 50.

During application, the spring's actuator portion is pushed into the inner housing, compressing the spring, and forming a circular aperture between the spring actuator and the central passageway for dispensing the fluid. Upon release, the spring force returns the actuator portion through the central passageway, and presses the valve's sealing surface into the central passageway against the underside of the inner housing's domed top surface, which stops the fluid flow.

The inner housing 12 may be formed with a 360-degree annular lip or bead 54 that locks under an interior lip on the container top orifice, thereby securely locking the housing assembly to the container tube. Once locked on the tube, an airtight seal is achieved between the inner diameter of the lip of the tube and the land area between the bead 54 and the area immediately below the dome of the inner housing. At the inner housing's lower open end 56, a 360-degree annular lip or bead 58 may be formed to secure the inner housing to the shoulder of the container. Alternatively, where the inner housing is formed with annular lips or beads, it may just as well be formed with annular grooves, and the container formed with the alternate mating lips or beads for securing attachment. Placement of the opposing securing ridges and grooves is a design convenience, and not a limiting factor in the application of the present invention.

Figure 6:
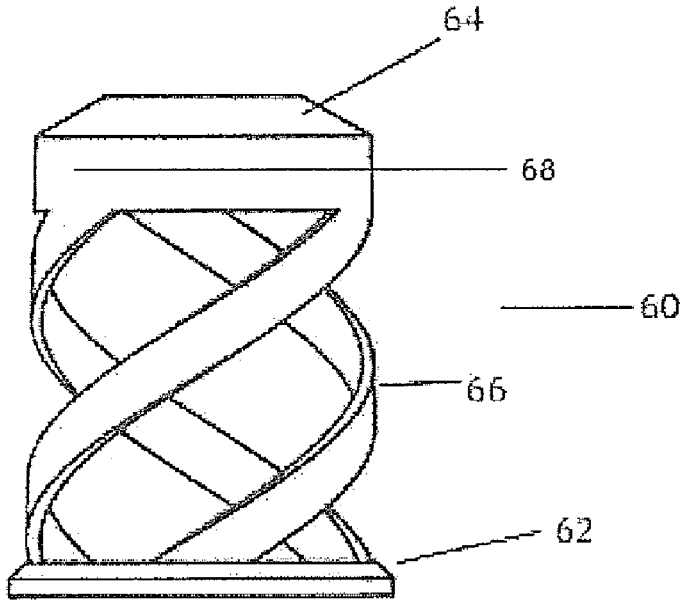
FIG. 6 depicts the preferred embodiment for the spring valve.

FIG. 6 depicts the preferred embodiment for the spring valve 60. The spring valve 60 generally comprises an actuator portion 62, a valve sealing surface 64, and an integral compression spring 66, which biases the valve to its closed position when assembled. The valve sealing surface 64 will have a seal line 68 where the spring valve presses against and underneath the top portion of the inner housing.

Referring to FIG. 5, the inner housing's central passageway 46 is not limited to a particular size and may vary based on the viscosity of the product or fluid dispensed. By varying the size of this orifice, or by varying the hardness of the molded spring materials, high viscosity lotions or creams may be uniformly dispensed as easily as thin, low viscosity liquids.

The inner and outer housings are attached to one another, preferably a permanent attachment by sonic welding. It is preferable to sonic weld the inner housing to the outer housing to ensure attachment of the covering materials between the two parts and keep the covering material from slipping during use. The welding may be circumferential or at multiple points about the periphery of the mating surfaces.

Figure 7:
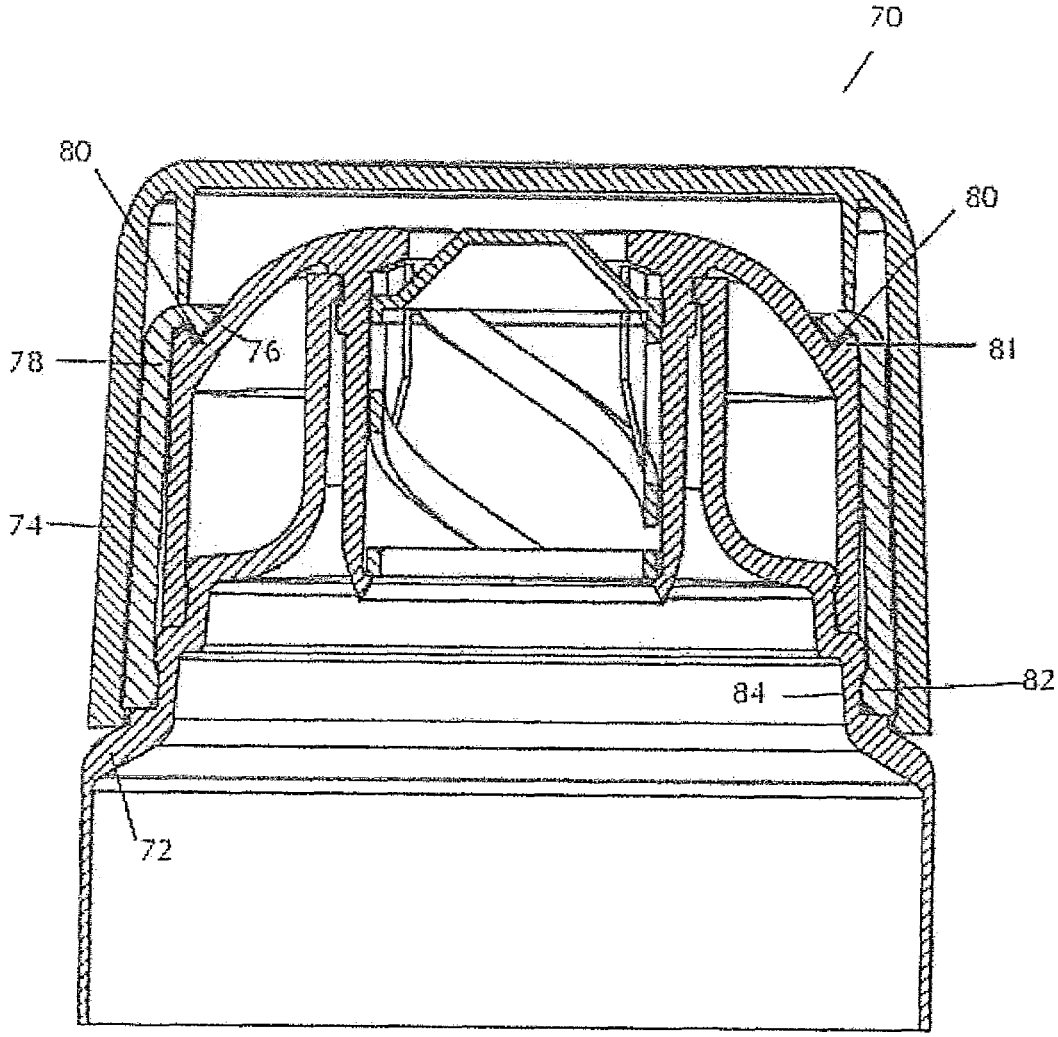
FIG. 7 depicts a cross-sectional view of the attaching inner and outer housings along with the mating container and accompanying cap.

FIG. 7 depicts a cross-sectional view of the attaching housings 70 along with the matting container 72 and accompanying cap 74. Inner housing 76 is shown pressed within outer housing 78. Sonic weld points 80 are located at each component to facilitate attachment. The inner housing is designed with a male ridge to serve as an energy director on its outer periphery, which is fit into a peripheral land area or receiving position Si on the internal periphery of the outer housing. This positioning provides the point of contact between the two housings and directs the energy force point. The sonic energy horn preferably directs the energy in a 360-degree weld, peripherally welding about the circumference of the joined components while trapping an optional covering material between the weld. It is certainly acceptable to sonic weld the housings in something less than a complete peripheral weld, As few as four sonic welded points have been demonstrated to adequately secure the two housings.

As shown in FIG. 7, the outer housing is depicted with a male ridge or lip 82 that mates with a receiving annular groove 84 on the container shoulder. Once again, a converse mating design may be implemented, with a groove in the outer housing and a mating receiving ridge on the inner housing. In FIG. 7, a spring valve is not shown, and is optionally required, depending in part upon the viscosity of the fluid being applied.

A comparison of the current swaging process technique, generally utilized by those skilled in the art, to the method of attachment of the present invention shows that time and resources are conserved by the application of the present invention. Typically, a swaging process of the types of components discussed herein would require many multiple seconds of dwell time to reform the plastic components to secure materials to the housings. Conversely, the present invention has been shown to effect retention of the housings and covering materials in less than one second, thereby affording a highly efficient and low cost production method.

Although the exact order of the manufacturing process is dependent upon numerous factors, one preferred method of attachment includes placing the inner housing to a shaped mandrel while cutting and placing the covering materials into position so that the outer housing can be slipped over the assembly and mechanically attached or sonic welded in place. Teeth and groove mating, thermal bonding, or adhesion may also be used to secure the two housings. If required, a spring valve is then inserted through the bottom into the inner housing's receptacle, and the assembly is attached to the cap.

The cap is designed to present the unique oval shape, having a flat top to permit the tube version of the package to stand on its head for point of purchase display purposes, and for maintaining higher viscosity fluids at the head end during storage. The interior of the cap has a flexible annular bead or lip extending from the inner top of the cap, and designed to make contact with the top outer edges of the housing assembly. This 360-degree contact establishes an effective airtight environment, preventing the covering material, foam pad, fabric, and/or product from drying out. The cap also has a bead design at the open end of the cap that secures the cap by snapping to the housing assembly. The present invention originated from the analysis of a broad variety of oval package shapes commonly used in the marketplace today. For example, the underarm stick deodorant container has a distinctive proportional oval shape between the major and minor axis, wherein the major axis is typically more than twice the size of the minor axis. The application of the present invention allows products of various viscosities to be dispensed in an oval proportioned package.

While the present invention has been particularly described, in conjunction with a specific preferred embodiment, it is evident that many alternatives, modifications and variations will be apparent to those skilled in the art in light of the foregoing description. Similarly, certain variations and modifications have been mentioned in the course of the description and others will certainly be suggested to the skilled worker without deviating from the broad scope of the invention. It is therefore contemplated that the appended claims will embrace any such alternatives, modifications and variations as falling within the true scope and spirit of the present invention.

Thus, having described the invention, what is claimed is:

1. A dispensing head comprising:

an inner housing including:

an inner housing top end;

an inner housing bottom open end;

a central passageway within said inner housing top end having a predetermined diameter to regulate product flow therefrom, said central passageway opening to an applicator pad; and an inner housing peripheral lip at said inner housing top end having a peripheral ridge or groove;

an outer housing including;

an outer housing top open end;

an outer housing bottom open end; and an outer housing peripheral annular lip at said outer housing top open end inwardly facing toward the center of said outer housing and having a peripheral land area for receiving a peripheral energy director of said inner housing, said outer housing peripheral annular lip in direction of said outer housing bottom open end, said outer housing including an annular ridge or groove at said outer housing bottom open end for attachment to a receiving annular groove or ridge on a product-filled container;

said applicator covering fixed between said inner housing and said outer housing, and placed over said central passageway;

wherein said inner housing is slideably fixed within said outer housing such that said applicator covering is held between said housings when said inner housing peripheral lip is mated with and secured to said outer housing receiving peripheral lip.

2. The dispensing head of claim 1 including said inner housing and said outer housing having a non-circular shape.

3. The dispensing head of claim 2 including said inner housing and said outer housing having an oval shape.

4. The dispensing head of claim 1 further comprising a foam pad secured underneath said applicator covering.

5. The dispensing head of claim 1 wherein said inner housing includes a top surface having said central passageway located approximately at said top surface center.

6. The dispensing head of claim 5 including splines or ridges located along said top surface of said inner housing for directing fluid flow, said splines or ridges extending outward from said central passageway.

7. The dispensing head of claim 1 including said outer housing having a dome shaped top surface comprising a plurality of apertures.

8. The dispensing head of claim 7 wherein said inner housing top surface is dome shaped having said dome face outward through said outer housing top open end.

9. The dispensing head of claim 1 including attachment between said inner housing peripheral lip and said outer housing peripheral annular lip, wherein said attachment comprises teeth and groove mating, sonic welding, thermal bonding, or adhesive.

10. The dispensing head of claim 1 further comprising:

a hollow cylindrical receptacle having an axial length and a bottom ridge, centered about said central passageway, and attached to said inner housing top end;

a spring valve disposed within said receptacle, securably fixed in position by said receptacle bottom ridge, having a closed end or cap to seal said central passageway, said spring valve including vertically winding spring coils, yieldable or compressible in a longitudinal direction about said receptacle's central axis, such that a relaxed length of said spring valve is greater than the axial length of said cylindrical receptacle, said spring valve forming an annular ring orifice with said central passageway for product flow when compressed during application.

11. An applicator for dispensing fluid to a surface comprising:

an oval shaped container having a top orifice with a first annular ridge or groove and a shoulder with at least one annular ridge or groove, for mating with a dispensing head;

said dispensing head including:

an oval shaped outer housing having a corresponding outer housing annular groove or ridge for mating with said at least one annular ridge or groove on said shoulder of said container, said outer housing having an inwardly facing top lip;

an oval shaped inner housing slideably inserted within said outer housing and having contact with said inwardly facing top lip, said inner housing having an inner housing annular groove or ridge for locking into and securing to said container top orifice for sealing said inner housing to a neck portion of said container, said inner housing having a central passageway of predetermined diameter to regulate product flow therethrough;

a covering material adapted to serve as a reservoir for the product and promote product flow during application, said covering material wedged and held securely between said inner and outer housings when said housings are fixably attached;

securing said housings together with said covering material wedged therebetween;

wherein said housings include at least one mating ridge and groove to form an attachment when said inner housing is slidably inserted within said outer housing.

12. The applicator of claim 11 including a foam pad for occluding product, located underneath said covering material.

13. The applicator of claim 12 comprising said inner housing having a dome shaped top surface, said dome outwardly facing through said outer housing when said housings are fixably attached.

14. The applicator of claim 13 including a plurality of apertures located throughout said dome shaped top surface for promoting product flow.

15. The applicator of claim 11 wherein said top orifice is located on said neck portion of said container, centered about and protruding from said shoulder.

16. The applicator of claim 11 wherein said inner housing further includes:

a hollow cylindrical receptacle having an axial length and a bottom ridge, centered about said central passageway, and attached to a top end of said inner housing;

a spring valve disposed within said receptacle, securably fixed in position by said receptacle bottom ridge, having a closed end or cap to seal said central passageway, said spring valve including vertically winding spring coils, yieldable or compressible in a longitudinal direction about said receptacle's central axis, such that a relaxed length of said spring valve is greater than the axial length of said cylindrical receptacle, said spring valve forming an annular ring orifice with said central passageway for product flow when compressed during application.

17. A dispensing head comprising:

an inner housing including:

an inner housing top end;

an inner housing bottom open end;

at least one aperture within said inner housing top end, having a predetermined diameter to regulate product flow therefrom; and an inner housing peripheral lip at said inner housing top end having a peripheral ridge or groove;

an outer housing including:

an outer housing top end;

an outer housing bottom open end;

a plurality of apertures within said outer housing top end, each having predetermined diameters to regulate product flow therefrom; and an outer housing peripheral annular lip at said outer housing top open end inwardly facing toward the center of said outer housing and having a peripheral land area for receiving said inner housing peripheral energy director, said outer housing peripheral annular lip in direction of said outer housing bottom open end, said outer housing including an annular ridge or groove at said outer housing bottom open end for attachment to a receiving annular groove or ridge on a product-filled container;

wherein said inner housing is slideably fixed within, and secured to, said outer housing.

* * * * *

UNITED STATES PATENT AND TRADEMARK OFFICE

CERTIFICATE OF CORRECTION

PATENT NO. : 7,344,328 B2
APPLICATION NO. : 10/931629
DATED : March 18, 2008
INVENTOR(S) : Brian McAuley It is certified that error appears in the above-identified patent and that said Letters Patent is hereby corrected as shown below:

Please amend the patent as follows:

Column 6, line 11, delete "ad 17" and substitute therefore -- pad 17 --

Column 6, line 56, delete "FIG. 2A" and substitute therefore -- FIG. 2 --

Column 6, line 57, delete "side view 42" and substitute therefore -- side view 24 --

Column 8, line 57, delete "position Si" and substitute therefore -- position 81 --

Column 8, line 65, delete "peripheral weld," and substitute therefore
-- peripheral weld. --

Signed and Sealed this

Second Day of December, 2008

JON W. DUDAS
*Director of the United States Patent and Trademark Office*